United States Patent [19]

Cooper

[11] Patent Number: 4,654,918

[45] Date of Patent: Apr. 7, 1987

[54] BUFFER DECK ASSEMBLY AND SURFACE MAINTENANCE APPARATUS

[75] Inventor: Donald K. Cooper, Symsonia, Ky.

[73] Assignees: Jerald T. Allcock, Symsonia; Billy D. Hargis, Gilbertsville, both of Ky.

[21] Appl. No.: 799,340

[22] Filed: Nov. 18, 1985

[51] Int. Cl.[4] ..... A47L 11/162

[52] U.S. Cl. ..... 15/98; 15/49 R; 51/177

[58] Field of Search ..... 15/49 R, 49 C, 50 R, 15/50 C, 98, 320, 385; 51/176, 177

[56] References Cited

U.S. PATENT DOCUMENTS

| | | | |
|---|---|---|---|
| 3,154,802 | 11/1964 | Hanschitz et al. | 15/49 R |
| 3,436,788 | 4/1969 | Tamny | 15/385 |
| 4,369,540 | 1/1983 | Burgoon et al. | 15/49 R |
| 4,490,873 | 1/1985 | Stratton | 15/49 R |

FOREIGN PATENT DOCUMENTS

| | | | |
|---|---|---|---|
| 941298 | 11/1963 | United Kingdom | 15/49 R |
| 2042331 | 9/1980 | United Kingdom . | |

*Primary Examiner*—Edward L. Roberts

*Attorney, Agent, or Firm*—King and Schickli

[57] ABSTRACT

A buffer deck assembly for floor scrubbing, cleaning and polishing machines includes a displaceable buffer deck housing mounted to the machine through a substantially U-shaped mounting frame having a pair of sleeves that each slidably receive a cantilever support arm. The opposite end of each cantilever support arm is pivotally mounted to the machine frame through a yoke and pivot pin. Coil springs received around each support arm engage the end of the sleeves of the deck mounting frame and bias the deck to an operative position where proper tension is provided to the drive belt for the buffer brush or pad. When the buffer deck housing is displaced rearwardly from the operative position, tension on the drive belt is released and power to the buffer brush or pad is interrupted. A mechanism is also provided for raising and lowering the buffer deck housing. The raising and lowering mechanism includes two connecting rods fixed to a rotatable shaft. The connecting rods are connected to the buffer deck mounting frame by means of a lost motion coupling including a chain link and a connecting loop.

16 Claims, 4 Drawing Figures

BUFFER DECK ASSEMBLY AND SURFACE MAINTENANCE APPARATUS

TECHNICAL FIELD

The present invention relates generally to the floor care field and, more particularly, to a buffer deck or head assembly and related surface maintenance apparatus for quickly and efficiently scrubbing, cleaning and polishing floors or the like.

BACKGROUND OF THE INVENTION

Hospitals, office buildings, grocery and department stores, shopping malls, gallerias and other large buildings typically have large open floor areas subject to heavy foot traffic. Typically, these areas are surfaced or covered in decorative terrazzo, vinyl, or other plastic or composite materials because of their long-wearing characteristics.

As should be appreciated, the heavy traffic using these facilities tends to track dirt and dust from outside the building all across the floor area. The need to clean the floor area is further compounded where food is served in the building. Soft drinks, ice cream, candy and other snack foods often drip or spill from containers being carried by busy workers or shoppers. Additionally, stocking clerks and customers handling, for example, foodstuffs in a grocery store, often break or spill the contents from containers thereby further complicating the problem. It should also be appreciated that the long wearing floor coverings are subject to scuff marks from, for example, hard soled shoes and shopping cart wheels. Thus, it is clear that frequent cleaning of these floor areas is desired at least once and preferably twice a week on a continuous basis.

As disclosed in U.S. Pat. No. 4,369,540 to Burgoon et al., it is known in the art to provide a floor cleaning machine that may be ridden and steered by the operator in order to scrub and clean large floor areas. While the Burgoon riding machine provides an efficient and effective way to clean large floor areas in a small amount of time, it, however, should be recognized that the Burgoon machine is not without its disadvantages.

For example, the Burgoon machine does not provide any effective way to clean the floor bordering a wall or floor corners without damaging the wall or the machine. The scrubbing brushes on the Burgoon machine do not extend beyond the frame and/or body of the main riding unit. As a consequence, any attempt to clean the floor edges or corners leads to potential damaging contact between the body or frame of the riding unit and the adjacent walls. Further, even if larger brushes were added to the Burgoon cleaning machine so as to extend clearly beyond the frame or body of the riding unit, the brushes or pads and possibly even the rotating backing plate supporting the brushes or pads would make contact with the wall. This contact disadvantageously tends to create unsightly scuff marks along the wall baseboard.

Additional problems with the Burgoon floor cleaning machine and others known in the art relate to the ability of the machine to follow the contour of the floor and maintain the cleaning brushes or polishing pads in proper floor contact at all times for effective operation. When this is not done, streaking and unsightly dirty areas often result at "low" spots of the floor. Other important considerations that need to be addressed in designing an improved operator-ridden floor buffer include the provision of a simplified buffer head or deck assembly that may be quickly and easily adjusted and repaired while also providing excellent operating efficiency. This last consideration is particularly important when it is realized that floor cleaning machines of this type are typically electrically driven through battery power.

SUMMARY OF THE INVENTION

Accordingly, it is a primary object of the present invention to provide an improved buffer deck or head assembly for a floor scrubbing, cleaning and/or polishing machine of simple construction providing more effective and efficient operation.

Another object of the present invention is to provide a buffer deck assembly better adapted to smoothly follow the contour of the floor being maintained.

Still another object of the present invention is to provide an improved buffer deck assembly furnishing particularly efficient operation while allowing quick and simple repair and adjustment of drive belts, cleaning brushes and polishing pads.

A further object of the present invention is to provide a buffer deck assembly furnishing the rider operator of a floor cleaning unit equipped therewith the ability to clean the edges and corners of the floor along walls while minimizing the risks of damaging the walls or the buffer machine.

An additional object of the present invention is to provide an improved surface maintenance machine or apparatus adapted to smoothly follow floor contours and allow the operator to safely and without damage clean floor corners and floor edges along a wall.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved buffer deck assembly of a surface maintenance machine for floor scrubbing, cleaning and/or polishing is provided. The buffer deck assembly includes a displaceable buffer deck housing supporting the rotating floor cleaning brushes or polishing pads. Means, such as cantilever support arms, are provided for mounting the buffer deck housing to the machine. A structure is provided for biasing the buffer deck housing to a normal operative position and interrupting the power or drive to the buffer deck housing on displacement of the housing from the operative position toward the machine. Thus, as the rotating brushes or pads of the buffer deck are brought into contact with the wall as, for example, when cleaning a corner or edge of the floor, powered operation of the pads or brushes is interrupted. Consequently, the pads or brushes of the buffer deck assembly of the present invention do not scuff or mar the wall as in the past.

Preferably, the buffer deck housing includes a substantially U-shaped deck mounting frame. The frame includes sleeves that slidably receive the mating cantilever support arms. A coil spring received around each cantilever support arm contacts the distal end of the sleeve and biases the deck mounting frame and buffer deck housing to the operative position. In the operative position, proper tension is placed on a drive belt that powers the rotating buffer brush or pad to clean and polish the floor.

A collar may be provided for adjusting the tension of the coil spring. The collar is received over the cantilever support arm and placed on the opposite side of the coil spring from the sleeve. The tension provided by the spring to bias the buffer deck housing may be increased by moving the collar against the spring toward the sleeve. Conversely, the tension provided by the coil spring may be reduced by moving the collar in the opposite direction along the support arm.

Preferably, the mounting frame is pivotally mounted to the buffer deck housing. Additionally, the cantilever support arms are each pivotally mounted to the machine as, for example, by a pivot pin and a yoke. Advantageously, these pivotal connections provide the buffer deck assembly of the present invention with a housing freely movable to accurately and completely follow the floor contour so as to provide more effective and efficient cleaning action.

The buffer deck housing may also be provided with means for raising and lowering the cleaning brush or pad from and to engagement with the floor. Thus, prior to and following the cleaning operation, the brush or polishing pad may be raised from the floor surface as the machine is driven from or to the storage area. The raising and lowering mechanism includes at least one connecting rod coupled to the deck mounting frame and fixedly attached at the opposite end to a rotatable shaft. An actuator lever is connected to this rotatable shaft. Movement of the actuator lever causes the shaft to rotate, thereby serving to raise and lower the buffer deck housing. Additionally, a lost motion coupling is provided between the connecting rod and the deck mounting frame. This coupling allows independent biasing action of the buffer deck assembly relative to the machine to and from the operative position. Thus, it should be appreciated that the raising and lowering mechanism in no way prevents the biasing of the buffer deck housing by the coil spring and movement to and from the operative position.

Preferably, power is provided to the rotating brush or pad of the buffer deck housing by means of an endless belt. Displacement of the buffer deck housing from the operative position advantageously releases the tension on the belt and interrupts the drive to the brush or pad.

Still other objects of the present invention will become readily apparent to those skilled in this art in the following description where there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
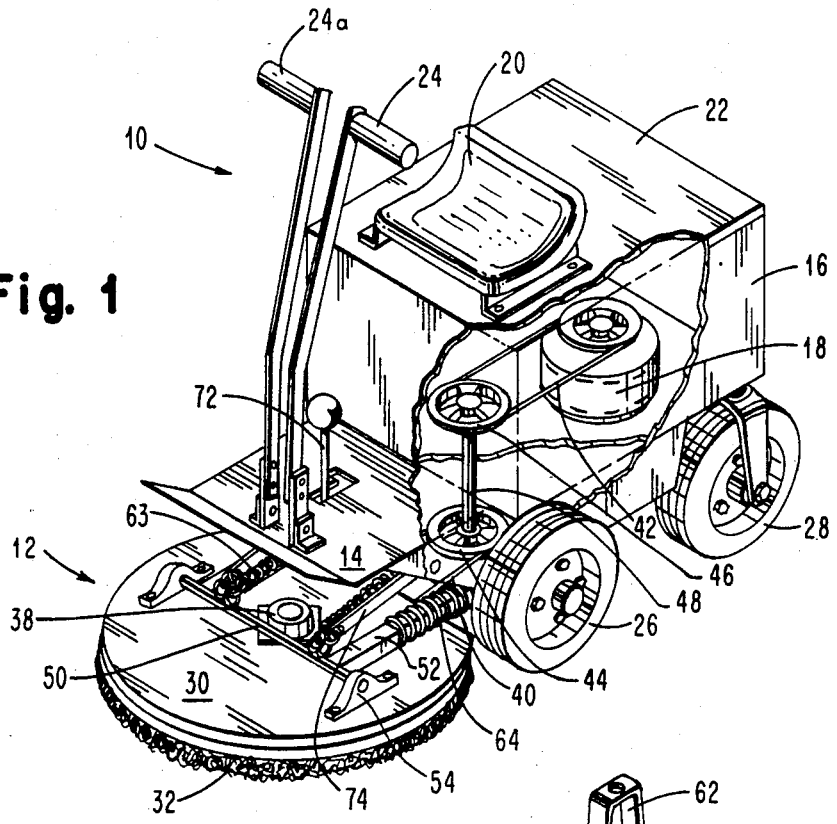
FIG. 1 is a perspective view of a surface maintenance apparatus for scrubbing, cleaning and/or polishing floors or the like constructed in accordance with one aspect of the present invention.

Reference is now made to FIG. 1 showing a surface maintenance apparatus or floor buffer 10 equipped with the buffer deck assembly 12 of the present invention. The floor buffer 10 includes a main frame member 14 and a body unit 16 housing an electric motor 18. The motor 18 is preferably powered by a battery (not shown) also contained within the body unit 16. A seat 20 for the rider/operator is mounted to the top 22 of the body unit 16.

Figure 3:
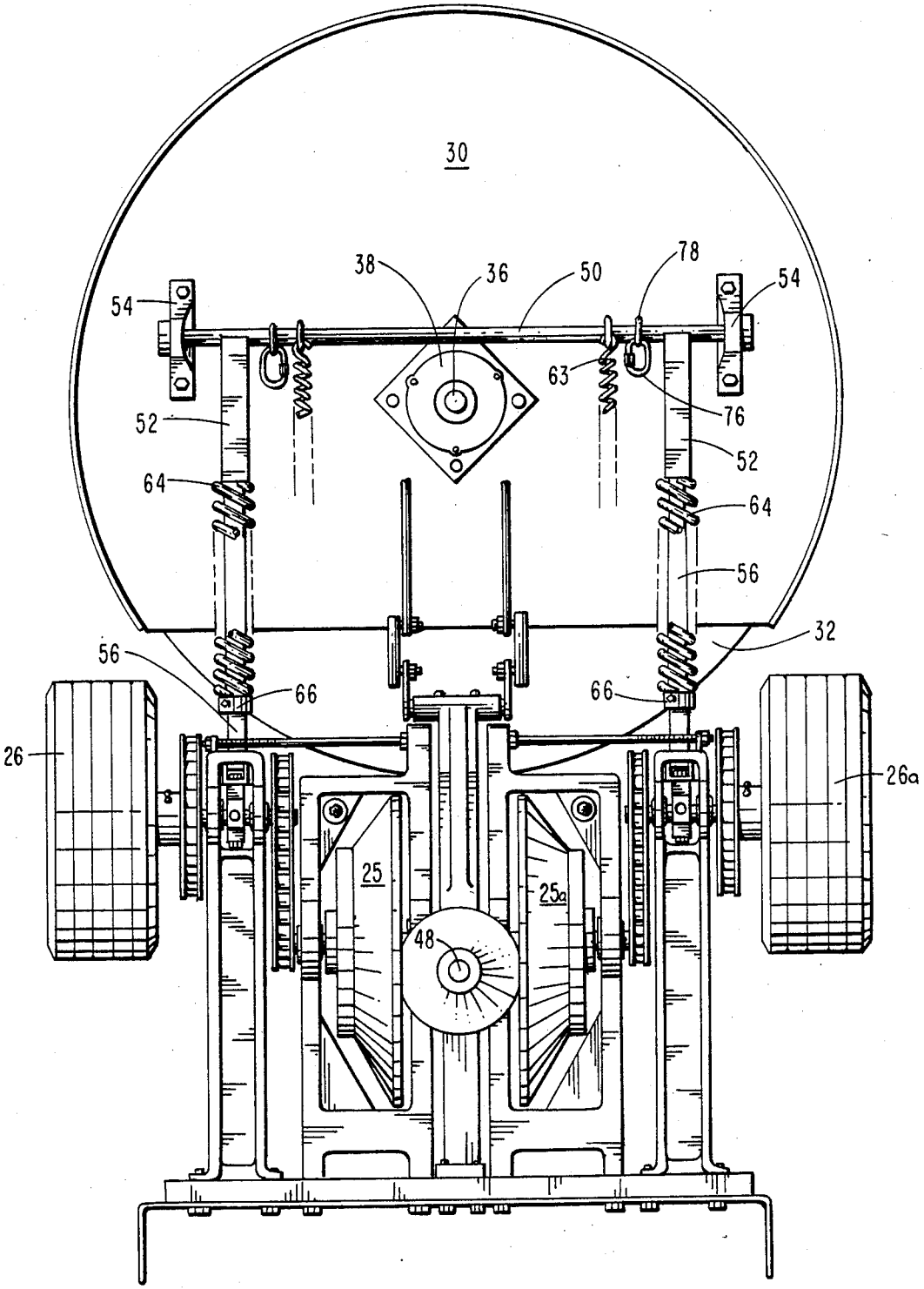
FIG. 3 is a top plan view of the buffer deck assembly of FIG. 2 with parts removed to show the deck housing and mounting structure in greater detail.

As shown in FIGS. 1 and 3, steering control is provided in the form of handles 24, **24*a* that operate dual clutches 25, 25*a* respectively. Each handle 24, 24*a* and clutch, 25, 25*a* controls the drive to a drive wheel 26, 26*a* (only one shown in FIG. 1). A single pivotal idler wheel 28 supports the weight of the floor buffer 10 at the rear. Together, the clutch controlled drive wheels 26, 26*a* and idler wheel 28 provide the floor buffer 10** with a turning radius of substantially zero so as to allow effective and efficient operation in tight corners and aisleways.

Figure 2:
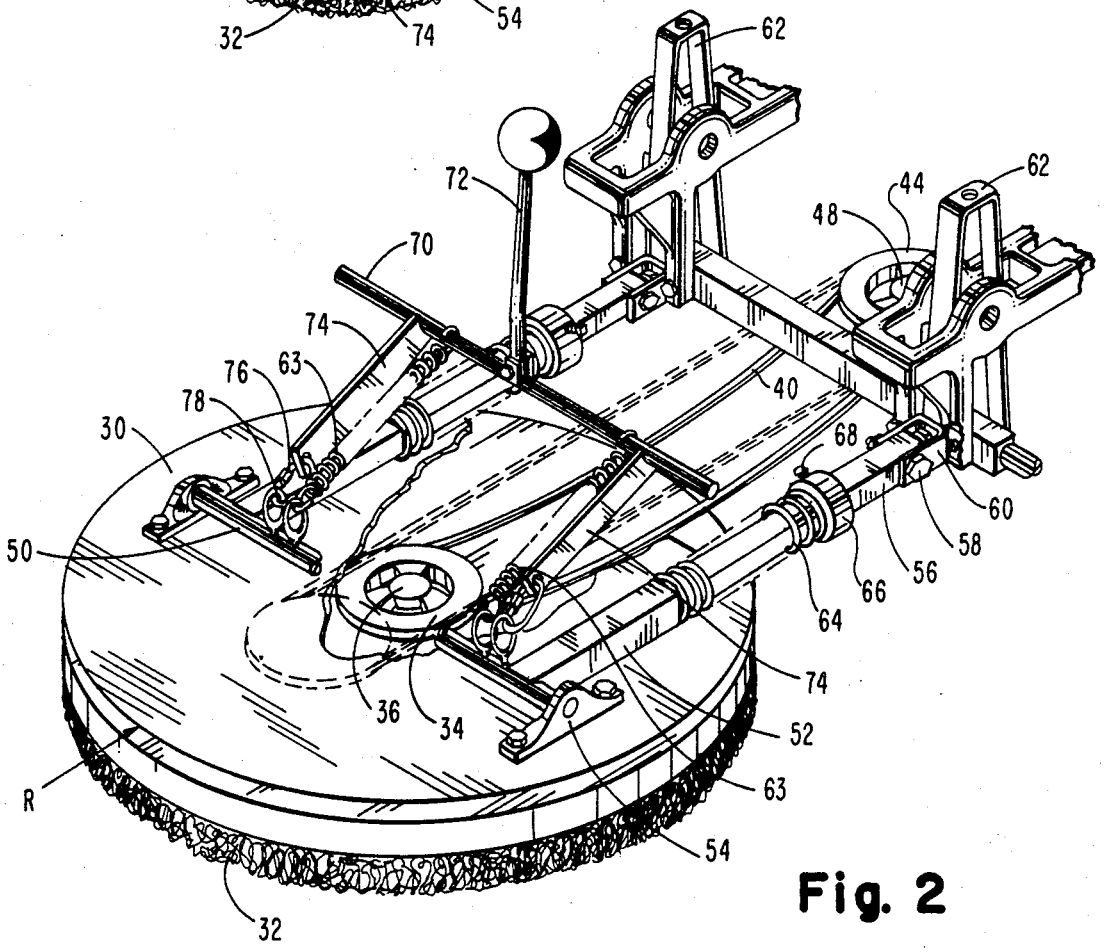
FIG. 2 is a perspective view of the buffer deck assembly of the present invention with parts removed to show the interrupting action of the drive belt.
Figure 4:
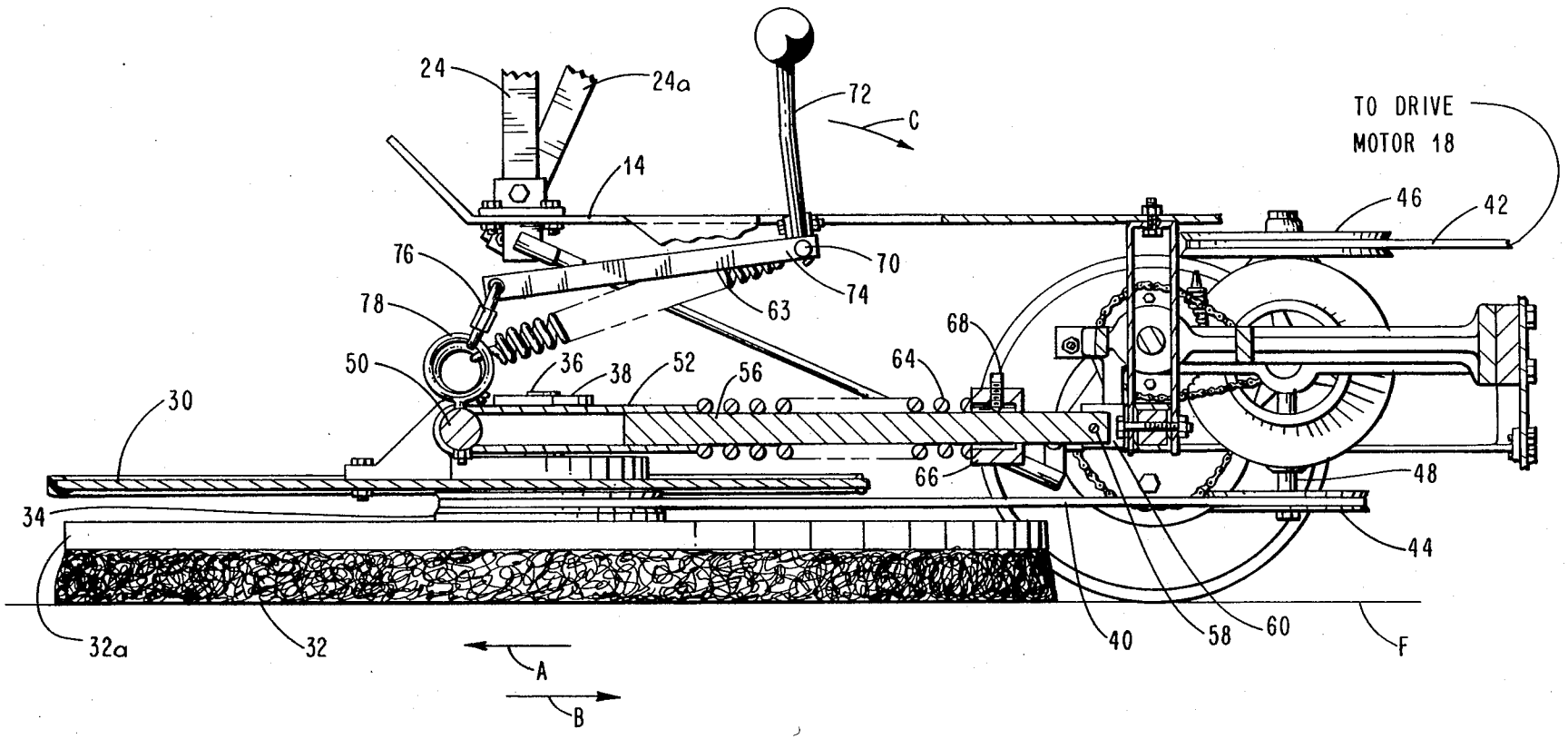
FIG. 4 is a cross-sectional view of the buffer deck assembly.

The buffer deck assembly 12 is best shown in FIGS. 2–4. The buffer deck assembly includes a displaceable buffer deck housing 30 substantially corresponding in circumference to the buffer pad or brush 32 used to polish or clean the floor F. The buffer pad 32 is mounted as, for example, by screws to pulley wheel 34 connected to stub shaft 36 that rotates relative to the deck housing 30 in bearing box 38. Drive from the motor 18 to rotate the buffer pad 32 is provided through the belts 40, 42 and pulleys 44, 46 mounted to the shaft 48.

The deck housing 30 includes a mounting frame 50 formed in a substantially U-shape and including a pair of sleeves 52. Pivotal mounting blocks 54 at each side of the mounting frame 50 allow the deck housing 30 to pivot relative to the mounting frame during operation so that the buffer pad 32 may follow the contour of the floor F and provide consistent cleaning action even over an undulating surface.

A cantilevered support arm 56 is slidably received in each sleeve 52 of the mounting frame 50. Each support arm 56 is connected by means of a pivot pin 58 and yoke 60 to a frame upright 62. Thus, the support arms 56 may pivot relative to the frame upright 62 to further allow the deck assembly 30 and, therefore, the buffer pad 32 to remain in contact with the floor F at all times during the cleaning and/or polishing operation. Springs 63 connected between the main frame 14 and the buffer deck mounting frame 50 help to support the weight of the buffer deck housing 30 to assure that the front edge of the housing or the pad support 32*a* does not contact and damage the floor F.

A coil spring 64 received around each support arm 56 engages the end of the sleeve 52 and biases the mounting frame 50 and deck housing 30 (in the direction of action arrow A) to an operative position away from the frame upright 62. In the operative position, the coil springs 64 maintain proper tension on the drive belt 40 through the single pulley 34 so that rotational power is provided directly to the buffer pad 32 to clean the floor F. The tensioning or biasing force of the coil springs 64 on the buffer deck housing 30 may be adjusted by means of a pair of collars 66, one collar slidably received on each support arm 56. By loosening the set screw 68 and moving the collars 66 along the support arms 56 toward the buffer deck housing 30, the tensioning or biasing force of the coil springs 64 against the buffer deck housing is increased. Conversely, by moving the collars 66 in the opposite direction along the support arms 56, the biasing force may be reduced.

As best shown in FIGS. 2 and 4, the buffer deck assembly 12 also includes a mechanism for raising and lowering the buffer deck pad 32 out of and into engagement with the floor F. The mechanism includes a shaft 70 mounted for rotation in the main frame 14 and actuated by means of a lever 72. Two connecting rods 74 fixed to the shaft 70 connect the shaft 70 to the buffer deck mounting frame 50. When the actuator lever 72 is moved rearwardly in the direction of action arrow C (note FIG. 4), the shaft 70 is rotated so as to draw the connecting rods 74 and buffer deck housing 30 in an upward direction away from the floor F. The buffer deck housing 30 may, of course, again be lowered into contact with the floor F by returning the actuator lever 72 to the forward position shown in FIG. 4.

In order to allow relative movement of the buffer deck housing 30 to the main frame 14 of the floor buffer 10, a lost motion coupling, such as chain link 76 and connecting loop 78, is provided between the connecting rods 74 and the deck mounting frame 50. Thus, the buffer deck housing 30 is free to be biased by the coil springs 64 to the operative position.

During floor buffer operation it is desirable to clean along walls where dirt often collects. As shown in FIG. 2, when the front end of the deck housing 30 is brought into head-on contact with a wall as, for example, when cleaning a corner, a force R is exerted on the housing. The force R causes the sleeves 52 of the mounting frame 50 to slide along the support arms 56 and compress the biasing springs 64. Thus, the deck housing 30 is allowed to be displaced rearwardly toward the uprights 62 (note direction of action arrow B in FIG. 4). The pulley 34 mounted to the deck housing 30 is also rearwardly displaced. The rearward displacement of the pulley 34 from the normal operating position (dashed line) to the full line position shown in FIG. 2 advantageously serves to relieve tension from the drive belt 40. This interrupts drive to the buffer pad or brush 32 which then stops rotating. Thus, it should be appreciated that the apparatus of the present invention provides protection to the wall and the floor buffer while also substantially eliminating wall scuffing or scarring with the brush or pad.

In summary, numerous benefits have been described which result from employing the concepts of the invention. The pivotal mounting of the deck mounting frame 50 and the support arms 56 advantageously allow the buffer pad 32 to remain in contact with the floor at all times during operation. The connection of the buffer deck housing 30 to the main frame and body unit of the floor buffer by means of the sleeves 52, support arms 56 and coil biasing springs 64 provides protection against wall damage. Interruption of the drive means by this feature also substantially reduces the possibility of scuffing the walls anytime the wall is engaged by the front of the machine. This is especially useful when cleaning in corners where the machine must be driven directly toward one of the walls. The buffer deck assembly further eliminates the need for an idler pulley to maintain tension on the pad driving belt 40 thereby reducing friction and providing a longer running time per battery charge. Additionally, it should be appreciated that the springs 64 automatically maintain the proper tension on the drive belt 40 even as the drive belt stretches with use. Additionally, repair and maintenance are simplified since the drive belt 40 and entire buffer deck 30 are easily removable from the floor buffer 10.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A buffer deck assembly for floor scrubbing, cleaning and polishing machines or the like, comprising:

a buffer means;

deck housing for said buffer means;

means for displaceably mounting said deck housing for movement relative to said machine;

means for biasing said buffer deck housing to a normal operative position;

drive means for operating said buffer means; and means for interrupting said drive means upon displacement of said buffer deck housing from said operative position.

2. The buffer deck assembly set forth in claim 1, wherein said displaceably mounting means includes at least one cantilever support arm.

3. The buffer deck assembly set forth in claim 2, wherein said deck housing includes a deck mounting frame.

4. The buffer deck assembly set forth in claim 3, wherein said deck mounting frame is substantially U-shaped.

5. The buffer deck assembly set forth in claim 3, wherein said deck mounting frame includes a sleeve that slidably receives said cantilever support arm.

6. The buffer deck assembly set forth in claim 5, wherein said means for biasing includes a coil spring received around said cantilever support arm; said coil spring biases said deck mounting frame and buffer deck housing to said operative position.

7. The buffer deck assembly set forth in claim 6, wherein means are provided for adjusting the tension on said coil spring.

8. The buffer deck assembly set forth in claim 7, wherein said adjusting means is a collar received over said cantilever arm and spaced from said deck mounting frame.

9. The buffer deck assembly set forth in claim 3, wherein said deck mounting frame is pivotally mounted to said deck housing.

10. The buffer deck assembly set forth in claim 3, wherein means are provided for raising and lowering said deck housing.

11. The buffer deck assembly set forth in claim 10, wherein said raising and lowering means includes at least one connecting rod coupled to said deck mounting frame and fixed to a rotatable shaft.

12. The buffer deck assembly set forth in claim 11, wherein a lost motion coupling is provided between said connecting rod and said deck mounting frame so as to allow displacement of said buffer deck assembly relative to said machine.

13. The buffer deck assembly set forth in claim 11, wherein an actuator lever is connected to said rotatable shaft, rotatin of said shaft serving to raise and lower said deck housing.

14. The buffer deck assembly set forth in claim 2, wherein said cantilever support arm is pivotally mounted to said machine by means of a pivot pin and a yoke.

15. The buffer deck assembly set forth in claim 1, wherein said drive means includes an endless belt and rearward displacement of said deck housing from said operative position releases tension on said belt and interrupts drive to said housing.

16. A surface maintenance apparatus for scrubbing, cleaning and polishing floors or the like, comprising:

a main frame and body unit;

drive means mounted to said main frame and body unit; and a buffer deck assembly including a deck housing displaceably mounted to said main frame and body unit, buffer means driven by said drive means, means for biasing said buffer deck housing to a normal operative position and means for interrupting drive to said buffer means on displacement of said deck housing from said operative position substantially toward said main frame and body unit.

* * * * *